United States Patent [19]

Meessen et al.

[11] Patent Number: 5,039,916

[45] Date of Patent: Aug. 13, 1991

[54] OPERATING CIRCUIT FOR A HIGH-PRESSURE DISCHARGE LAMP

[75] Inventors: Lodewijk H. M. Meessen; Ralf Schäfer, both of Eindhoven; Steven Kemmink, Oss; Hilbert Palmers, Eindhoven, all of Netherlands

[73] Assignee: U.S. Philips Corporation, New York, N.Y.

[21] Appl. No.: 875,413

[22] Filed: Jun. 17, 1986

[30] Foreign Application Priority Data

Dec. 17, 1985 [NL] Netherlands ..... 8503462
Mar. 28, 1986 [NL] Netherlands ..... 8600812

[51] Int. Cl.[5] ..... H05B 37/00

[52] U.S. Cl. ..... 315/200 R; 315/224; 315/307; 315/DIG. 7; 315/DIG. 5

[58] Field of Search ..... 315/224, 307, 308, DIG. 7, 315/199, 198, DIG. 5

[56] References Cited

U.S. PATENT DOCUMENTS 4,356,433 10/1982 Linden ..... 315/308

*Primary Examiner*—Michael Razavi
*Attorney, Agent, or Firm*—Bernard Franzblau

[57] ABSTRACT

A circuit arrangement suitable for operating a high-pressure discharge lamp (80) in conjunction with a controlled current limiter (6) by means of a control signal which is at least composed of the sum of a lamp-voltage-dependent signal part and a lamp-current-dependent signal part. The invention, the absolute value of the lamp-current-dependent signal part is chosen to be smaller than the absolute value of the lamp-voltage-dependent signal part. The circuit arrangement provides a rapid control, which keeps the lamp voltage substantially constant.

17 Claims, 1 Drawing Sheet

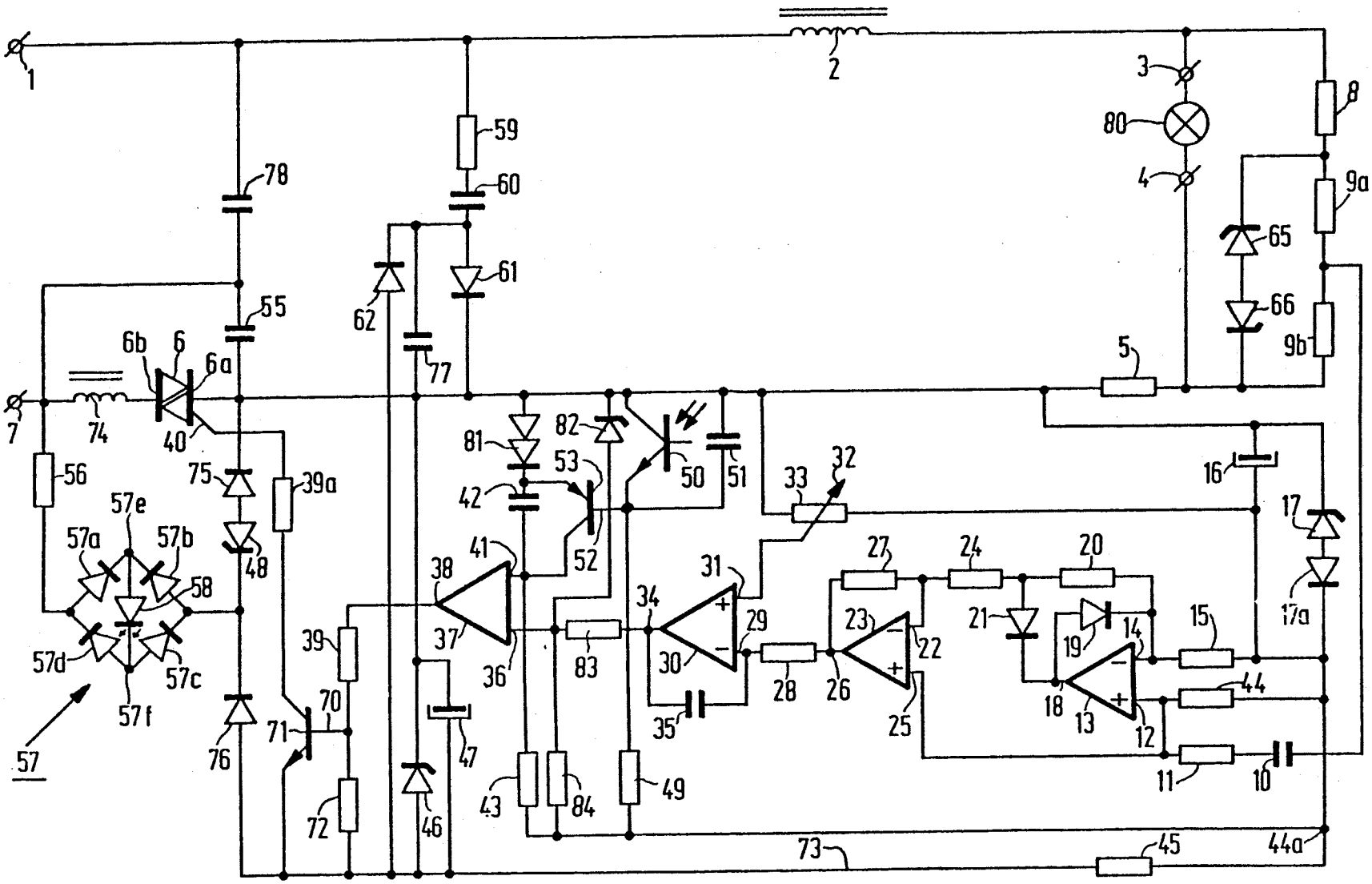
1
2
3
4
5
6
6a
6b
7
8
9a
9b
10
11
12
13
14
15
16
17
17a
18
19
20
21
22
23
24
25
26
27
28
29
30
31
32
33
34
35
36
37
38
39
39a
40
41
42
43
44
44a
45
46
47
48
49
50
51
52
53
55
56
57
57a
57b
57c
57d
57e
57f
58
59
60
61
62
65
66
70
71
72
73
74
75
76
77
78
80
81
82
83
84

OPERATING CIRCUIT FOR A HIGH-PRESSURE DISCHARGE LAMP

BACKGROUND OF THE INVENTION

This invention relates to a circuit arrangement for operating a high-pressure discharge lamp in conjunction with a controlled current limiter by means of a switching signal produced in the circuit arrangement and resulting from at least a first comparison of a lamp-dependent control signal S with a reference signal. The control signal S is at least composed of a summation of a lamp-voltage-dependent part and a lamp-current-dependent part. The invention further relates to a device provided with the circuit arrangement and to a lamp provided with the circuit arrangement.

A circuit arrangement of the kind mentioned in the opening paragraph is known from U.K. Patent Specification 1,167,920.

The known circuit arrangement is connected to two thyristors arranged in parallel with opposite polarities as a controlled current limiter. A coil operative as a current stabilization ballast is connected in series with the thyristors. The anti-parallel connected thyristors may be replaced by a triac. However, it is alternatively possible that the combination of thyristors and current stabilization ballast be replaced as a whole by a controlled current limiter.

It is common practice for high-pressure discharge lamps to be operated with an alternating voltage or with a pulsatory direct voltage. The power at which the lamp is operated is to be understood here to mean the power averaged over a time which is long as compared with the period of the alternating voltage and the pulse voltage, respectively. An average lamp voltage and current, respectively, may be formed by averaging in time the absolute value of the lamp voltage and lamp current, respectively. Another way in which an average lamp voltage and lamp current, respectively, may be formed is by the root of the time average of the square of the lamp voltage and current, respectively, the so-called R.M.S. value. In each period of the alternating voltage, the actual lamp voltage waveform will include a time period of comparatively very low voltage value, a re-ignition peak voltage and a time period having a comparatively high and approximately constant voltage value. The comparatively high approximately constant value is known under the designation of plateau voltage and its time duration corresponds to the time duration in which a discharge arc occurs.

In the known circuit arrangement, a high-pressure discharge lamp can be operated at a substantially constant power. For this purpose, at a nominal value of the lamp current and a nominal value of the lamp voltage and lamp-current-dependent part of the control signal is chosen to be equally as large as the lamp-voltage-dependent part. For a lamp with a work-point in the proximity of the nominal values of the average lamp voltage and the average lamp current, the control signal thus summed forms a very close approximation to a control procedure according to the product of lamp voltage and lamp current. A circuit arrangement in which signals are subjected to an addition can be practically realized in a considerably simpler manner than a circuit arrangement in which a multiplication of signals is effected.

High-pressure discharge lamps, more particularly high-pressure sodium discharge lamps, form very efficient light sources which are frequently used. A general phenomenon, especially of high-pressure sodium discharge lamps, is that during the lamp life time the lamp voltage varies. This influences not only the power consumed by the lamp and the intensity of the luminous flux emitted by the lamp, but also, as has been found, the color temperature $T_c$ of the light emitted by the lamp.

SUMMARY OF THE INVENTION

The invention has for an object to provide a circuit arrangement suitable for operating a high-pressure discharge lamp in which the average lamp voltage is kept substantially constant. According to the invention, for this purpose a circuit arrangement of the kind mentioned in the opening paragraph is characterized in that the summation satisfies the relation $$S = C\left(\beta \frac{I_{La}}{I_{La,n}} + \frac{V_{La}}{V_{La,n}}\right) \text{with } 0.1 < \beta < 1,$$

where $I_{La}$ is the current through the lamp in A, $I_{La,n}$ is the nominal lamp current in A, $V_{La}$ is the voltage across the lamp in V, $V_{La,n}$ is the nominal lamp voltage in V, $\beta$ is constant, and C is a proportionality constant expressed in V.

The nominal lamp current and voltage, respectively, are the nominal values of the average lamp current and lamp voltage, respectively. The current through the lamp may be the instantaneous lamp current. However, it is also possible for the satisfactory operation of the circuit arrangement to use the average lamp current. Likewise, the instantaneous lamp voltage may be used as the voltage across the lamp, but the average lamp voltage may also be utilized. For the average lamp voltage and lamp current, respectively, the R.M.S. value, as well as the value of averaging the absolute value, may be chosen. Although a difference may occur between these values, this difference does not detrimentally affect the satisfactory operation of the circuit arrangement. Preferably, the factor $\beta$ satisfies the relation $0.1<\beta<0.5$. When the average lamp voltage is kept substantially constant, it is achieved on the one hand that the life time is lengthened and on the other hand that the colour temperature $T_c$ remains highly constant. Furthermore, the use of the circuit arrangement leads to a reduction of the spread in lamp properties between individual lamps of the same type.

In lamps with sodium as a filling constituent, the colour temperature $T_c$ of the emitted radiation is related to the pressure of the sodium in the discharge vessel of the lamp. In the case of an excess filling of the discharge vessel, the sodium pressure is determined by the temperature of the sodium present in excess. The filling of the discharge vessel of high-pressure sodium discharge lamps generally consists of a sodium-mercury amalgam and a rare gas. The composition and the temperature of the amalgam are then of important factors for the lamp voltage because the latter is a function of the relative Na and Hg pressure. So long as the amalgam composition does not change due to disappearance of sodium, it is possible by keeping the average lamp voltage constant to also keep the Na pressure constant.

A property of at least high-pressure sodium discharge lamps is that with an abrupt variation of the average lamp current the average lamp voltage varies abruptly with an opposite polarity and then varies gradually with the same polarity as that of the current variation until a stable work-point associated with the varying lamp current is attained. A control technique is which a control signal is only dependent upon the lamp voltage requires in such a case a comparatively long time constant (of the order of a few tens of seconds) of the controlling process to obtain a stable control, as a result of which the quantity to be controlled, i.e. the lamp voltage, will be subjected to comparatively large variations. Besides, it is very objectionable when a time constant of a few tens of seconds is required in a circuit arrangement.

When now a fraction having a polarity corresponding to the polarity of the current variation is added to the control signal, the required time constant of the controlling process can be shortened, as a result of which the control of the lamp voltage can be effected much more rapidly and the relevant circuit arrangement can be considerably simplified. According to the invention, the fraction chosen is $$C \cdot \beta \frac{I_{la}}{I_{la,n}}$$

preferably, $\beta$ is then chosen so that it holds for the control signal that $$\frac{\Delta S}{C\Delta I} > 0.$$

where $\Delta I$ is an abrupt variation in the lamp current and $\Delta S$ is an abrupt variation in the control signal S as a result of $\Delta I$.

The control operation can then take place substantially instantaneously. This has the further advantage that the circuit arrangement can be simpler and such a choice of $\beta$ then reduces the cost. When the value of $\Delta S/C\Delta I$ is kept small and hence the value of $\beta$ is also kept small, it is achieved that the control is mainly based on the lamp voltage, which yields the optimum result for keeping constant the color temperature $T_c$.

Lamp experiments have shown that a $\beta$ of at least 0.1 is required to obtain a time constant of the controlling process which is at most 1 s.

In an embodiment of the circuit arrangement according to the invention, the switching signal is also the result of a second comparison of a sawtooth-shaped signal with an auxiliary signal proportional to the control signal S and a direct voltage signal is added to the sawtooth-shaped signal. An advantage of this preferred embodiment is that due to the choice of the value of the added direct voltage signal, the control range of the circuit arrangement can be adjusted in a comparatively simple manner.

A preferred embodiment of the circuit arrangement comprises a part for forming the sawtooth-shaped signal and this part comprises a first series-combination of a first semiconductor element with a diode characteristic, a capacitor shuntable by a switch, and a first resistor, while a junction of capacitor and first resistor is connected to a first input of the operational amplifier intended to carry out the second comparison. The first semiconductor element with the diode characteristic ensures in a very simple manner that a direct voltage signal is added to the sawtooth-shaped signal. The term "diode characteristic" in this description and the claims includes a characteristic of a Zener diode.

In a further preferred embodiment of the circuit arrangement, a second series-combination comprising a first semiconductor element with a Zener characteristic and a second resistor is connected parallel to the first series-combination and a junction of the first semiconductor element with the Zener characteristic and the second resistor is connected to a second input of the operational amplifier, this input serving as a connection for the auxiliary signal. This embodiment has the advantage that due to the semiconductor element with the Zener characteristic the value of the signal at the second input is always smaller than the maximum attainable value of the sawtooth-shaped signal.

In another preferred embodiment of the circuit arrangement according to the invention, the circuit arrangement comprises a voltage divider circuit which, when the lamp is connected, is arranged electrically parallel to the lamp and of which a first part serves to obtain the lamp voltage-dependent part of the control signal S. This first part is shunted by at least a second semiconductor element with a diode characteristic.

In a further embodiment, which is suitable for operation of the lamp with an alternating voltage, the first part of the voltage divider circuit is shunted by a second and a third semiconductor element with a Zener characteristic and connected with opposite polarities.

The preferred embodiments described have the great advantage that due to mutual adaptation of the voltage division in the voltage divider circuit and diode forward voltage or Zener voltage of the semiconductor elements, substantially only the plateau voltage of the lamp voltage contributes to the lamp-voltage-dependent part of the control signal S. As a result, $\beta$ can also be chosen to be smaller, as experiments have shown.

It is achieved with the use of two semiconductor elements with opposite polarities that during both polarity parts of the alternating voltage supply the lamp-voltage-dependent part of the control signal is formed in the same manner. This prevents the lamp from flickering. This is advantageous, especially for comparatively low frequencies (50 Hz) of the alternating voltage. The use of semiconductor elements with a Zener characteristic then has the advantage that the influence of the ambient temperature on the operation of the circuit arrangement is greatly reduced.

The circuit arrangement may be constructed as a separate device. Preferably, the circuit arrangement is joined with the controlled current limiter to form a single device. It is also conceivable that the circuit arrangement is joined with both the controlled current limiter and a current stabilization ballast to form a sing device.

BRIEF DESCRIPTION OF THE DRAWING

An embodiment of a circuit arrangement according to the invention will be described more fully with reference to accompanying drawing.

DESCRIPTION OF THE PREFERRED EMBODIMENTS

In the drawing, a first connection terminal 1 is connected through a stabilization ballast 2 to a lamp connection terminal 3. Another lamp connection terminal 4 is connected via a resistor 5 to a main electrode 6a of a controlled current limiter 6 constructed as a triac. Another main electrode 6b of the triac 6 is connected via a coil 74 to a second connection terminal 7. The lamp connection terminal 3 is connected through a series-combination of a resistor 8, a resistor 9a and a resistor 9b to the lamp connection terminal 4.

A junction between resistors 9a and 9b is connected through a capacitor 10 and a resistor 11 to a positive input 12 of a first operational amplifier 13. A negative input 14 of the first operational amplifier 13 is connected via a resistor 15 and a capacitor 16 to the main electrode 6a of the triac 6. The capacitor 16 is shunted by a series-combination of a Zener diode 17 and a diode 17a connected with opposite polarities.

An output 18 of the first operational amplifier 13 is connected via a diode 19 to the negative input 14. A resistor 20 is connected at one end to the input 14 and is connected at another end on the one hand via a diode 21 to the output 18 of the first operational amplifier 13 and on the other hand via a resistor 24 to a negative input 22 of a second operational amplifier 23. A positive input 25 of the second operational amplifier 23 is connected to the positive input 12 of the first operational amplifier 13. An output 26 of the second operational amplifier 23 is connected through a resistor 27 to the negative input 22.

At the same time, the output 26 is connected via a resistor 28 to a negative input 29 of a third operational amplifier 30. A positive input 31 of the third operational amplifier 30 is connected to an adjustable tapping 32 on a potentiometer 33. The potentiometer 33 is connected on the one hand to the resistor 15 and on the other hand to the main electrode 6a of the triac 6. The op-amp 30 operates as a first comparator for comparing a reference signal at input 31 with a signal at input 29 determined by the control signal S.

An output 34 of the third operational amplifier 30 is connected on the one hand via a capacitor 35 to the negative input 29 and on the other hand via a resistor 83 to a positive input 36 of a fourth operational amplifier 37. The positive input 36 of the fourth operational amplifier 37 is also connected via a Zener diode 82 to the main electrode 6a of the triac 6. The op-amp 37 functions as a second comparator. An output 38 of the fourth operational amplifier is connected via a resistor 39 to a base 70 of a transistor 71. The base 70 is also connected through a resistor 72 to a common lead 73, from which (in a manner not shown) the operational amplifiers (13,23,30,37) are supplied. The transistor 71 is connected on the one hand to the lead 73 and on the other hand via a resistor 39a to a control electrode 40 of the triac 6.

A negative input 41 of the fourth operational amplifier 37 is connected on the one hand via a capacitor 42 in series with a stabistor 81 to the main electrode 6a of the triac and on the other hand via a resistor 43 in series with a resistor 45 to the lead 73. The positive input 12 of the first operational amplifier 13 is connected via a resistor 44 and the resistor 45 to the lead 73. The capacitor 16, the potentiometer 33 and the resistor 15 are also connected via the resistor 45 to the lead 73. In turn, the lead 73 is connected through a parallel combination constituted by a Zener diode 46 and a capacitor 47 to the main electrode 6a of the triac 6. The junction 44a is also connected on the one hand via a resistor 84 to the positive input 36 of the amplifier 37 and on the other hand via a resistor 49 to a photosensitive transitor 50, which in turn is connected to the main electrode 6a of the triac 6. The photosensitive transistor 50 constitutes, together with a light-emitting diode 58, an optocoupler 50–58. The photosensitive transistor 50 is shunted by a capacitor 51. At the same time, the photosensitive transistor 50 is connected to the base 52 of a transistor 53, which shunts the capacitor 42.

The triac 6 and the coil 74 are shunted by a parallel-combination, a first branch of which is formed by a capacitor 55 and a second branch by a series-combination of a resistor 56, a rectifier bridge 57, a Zener diode 48 and a diode 75. The polarities of the Zener diode 48 and the diode 75 are opposite to each other. The rectifier bridge 57 comprises the diodes 57a, 57b, 57c and 57d.

Rectifier terminals 75e and 57f of the rectifier bridge 57 are connected to each other through the light-emitting diode 58. At the same time, the rectifier bridge 57 is connected via the diode 76 to the lead 73. The connection terminal 1 is connected via a resistor 59, a capacitor 60 and a diode 61 to the main electrode 6a. At the same time, the connection terminal 1 is connected via the resistor 59, the capacitor 60 and the diode 62 to the lead 73. The diode 61 is shunted by a capacitor 77 and a capacitor 78 is connected to the connection terminals 1 and 7. The resistors 9a and 9b are shunted by a series-combination of a Zener diode 65 and a Zener diode 66 having opposite polarities. A discharge lamp 80 is connected between the lamp connection terminals 3 and 4. For starting the lamp 80, the latter may be provided with an internal starter. Alternatively, an external starter may be provided which is preferably connected between the lamp connection terminals 3 and 4. The circuit arrangement shown is suitable for operating a high-pressure discharge lamp from an alternating voltage supply source. The operation of the circuit arrangement can be explained as follows. The instantaneous alternating voltage across the resistor 9b constitutes the lamp-voltage-dependent part of the control signal S and the instantaneous alternating voltage across the resistor 5 constituted the lamp-current-dependent part. Thus, in this embodiment of the circuit arrangement, the instantaneous values of the lamp current and the lamp voltage, respectively, are used for the current through the lamp $I_{Ia}$ and the voltage across the lamp $V_{Ia}$, respectively. The summation of these alternating voltages, thus constituting the control signal S, is applied via the capacitors 16 and 10 to the input terminals 14 and 12 of the operational amplifier 13. The size ratio of the resistors 5 and the voltage divider circuit 8, 9a, 9b then determines the values of $\beta$ on the one hand and $CI_{i\,Ia,n}$ and $CV_{i\,Ia,n}$ on the other hand. The circuit of operational amplifiers 13 and 23 forms from the alternating voltage control signal S at the inputs 12 and 14 a rectified signal at the input 29 of the operational amplifier 30. In the operational amplifier 30, this rectified signal is integrated on the one hand and is compared on the other hand with the direct voltage at the input 31 originating from the adjustable tapping 32 on the potentiometer 33. This integration means the averaging of $|S|$ and thus the averaging of the absolute values of the current through the lamp and the voltage across the lamp. The integration is effected with a time constant which is determined by the resistor 28 and the capacitor 35. The time constant is chosen to be large compared with the time duration per half cycle of the alternating voltage in which the triac 6 is non-conducting. A time constant of the order of the half cycle of the alternating voltage is then to be preferred. Due to the integration, the possibility of flickering of the lamp is reduced. The direct voltage originating from the adjustable tapping 32 on the potentiometer 33 serves as a reference signal and is fixed during adjustment of the circuit arrangement by adjusting the potentiometer 33. This adjustment further ensures that the influence on the switching signal due to differences between individual elements of the circuit arrangement is greatly reduced. The said differences are mainly due to a spread in the values of the components used in the circuit arrangement. An auxiliary signal, which is thus obtained at the output 34 and is proportional to the control signal S, is compared in the operational amplifier 37 as a second comparison with a sawtooth-shaped signal in such a manner that a low voltage is applied to the output 38 of the operational amplifier 37 as long as the auxiliary signal is larger than the sawtooth-shaped signal, while in any other case a high voltage is applied. Thus, the operational amplifier 37 constitutes the operational amplifier intended for carrying out the second comparison with 41 as a first input and 36 as a second input, the latter serving as a connection for the auxiliary signal. The input 41 is connected to a junction of the capacitor 42 and the resistor 43, which form part of a first series-combination of a part of the circuit arrangement for forming a sawtooth-shaped signal. The stabistor 81 is then a first semiconductor element with diode characteristic of the first series-combination, and the resistor 43 the first resistor. For the capacitor 42, which is shuntable by a switch, the transistor 53 serves as the shunting switch. The optocoupler 58-50 and the first series-combination of the transistor 53 and the capacitor 51 together constitute the part of the circuit arrangement for forming the sawtooth-shaped signal.

A second series-combination connected parallel to the first series-combination comprises the Zener diode 82 as the first semiconductor element with the Zener characteristic and the resistor 84 as the second resistor. A junction between the Zener diode 82 and the resistor 84 is connected, as described, to the positive input 36 of the operational 71 becomes conductive and the triac 6 is rendered conductive via the control electrode 40 of the triac. The triac 6 will be rendered non-conducting when at the end of each half cycle of the alternating voltage, the current through the triac has fallen to a value near zero. The voltage at the output 38 thus constitutes the switching signal produced in the circuit arrangement.

In the non-conducting state of the triac 6, the circuit comprising the resistor 56, the rectifier bridge 57, the Zener diode 48 and the diode 75 forms a shunt in a half cycle of the alternating supply voltage, as a result of which a so-called keep-alive current is maintained through the lamp 80. In the next half cycle of the alternating voltage, the keep-alive current flows through the circuit 46, 47, 76, 57 and 56. The keep-alive current ensures that ionization in the lamp is maintained during the non-conducting state of the triac 6, which improves the re-ignition of the lamp when the triac 6 becomes conducting. The keep-alive current further results in that the light emitting diode 58 emits light, so that the photosensitive transistor 50 is conducting and hence the transistor 53 is non-conducting. The capacitor 42 will then be charged via the stabistor 81, as a result of which the value of the voltage at the input 41 of the operational amplifier 37 increases. When the voltage at the input 41 becomes equal to the voltage at the input 36 of the amplifier 37, the triac 6 becomes conducting via the circuit 38, 39, 71, **39*a* and 40. However, as soon as the triac 6 is conducting, no current will flow any longer through the light-emitting diode 58, which results in a conducting state of the transistor 53, so that the capacitor 42 is discharged abruptly and the value of the voltage at the input 41 decreases abruptly. As a result, the sawtooth-shaped signal is obtained at the input 41**.

By means of the circuit 59, 60, 62, 46 and 47, a direct voltage is formed between the main electrode **6*a* and the conductor 73 and this voltage provides, in a manner not shown, the supply voltage for the operational amplifiers 13, 23, 30 and 37. Via the resistor 45, the Zener diode 17 and the diode 17*a*, the adjustment point of the transistors 50 and 53 and the adjustment point of the operational amplifiers is determined. The circuit elements 55, 74, 78 and 77 ensure that radio-interference is suppressed. Furthermore, the coil 74 serves together with the capacitors 78 and 55** to ensure that the circuit arrangement is insensitive to any interference pulses originating from the alternating-voltage supply source.

The Zener diodes 65 and 66 ensure that the lamp-voltage-dependent part of the control signal S is mainly influenced by the plateau voltage of the lamp.

The combination of the Zener diode 48 and the diode 75 with opposite polarities ensures together with the diode 76 and the Zener diode 46 that the keep-alive current has the same value in each half cycle of the alternating voltage supply and moreover that the sawtooth-shaped signal at the input 41 is not dependent upon the polarity of the alternating voltage.

The stabistor 81 ensures that a direct voltage signal is added to the sawtooth-shaped signal at the input 41. The resistors 83, 84 ensure that the required voltage for satisfactory operation is present at the input 36 of the operational amplifier 37. It is achieved with the Zener diode 82 that the voltage at the input 36 has a smaller value than the maximum attainable value of the sawtooth-shaped signal at the input 41.

In order to prevent any overload of the resistor 5, the latter may be shunted by two diodes with opposite polarities.

A circuit arrangement of the kind described and suitable for operating a 50 W high-pressure sodium lamp of 200 V, 50 Hz, was proportioned as follows.

| | |
|---|---|
| resistor 8 | 220 kOhm |
| resistor 9a | 15 k |
| resistor 9b | 2.7 k |
| resistor 5 | 0.56 Ohm |
| resistor 15 | 59 k |
| resistor 11 | 10 k |
| resistor 20 | 59 k |
| resistor 24 | 59 k |
| resistor 27 | 118 k |
| resistor 28 | 100 k |
| resistor 39 | 10 k |
| resistor 39a | 910 Ohm |
| resistor 43 | 16 k |
| resistor 44 | 59 k |
| resistor 45 | 5.6 k |
| resistor 49 | 16 k |
| resistor 56 | 4.7 k |
| resistor 59 | 820 Ohm |
| resistor 72 | 10 k |
| resistor 83 | 56 k |
| resistor 84 | 10 k |
| potentiometer 33 | 4.7 kOhm |
| capacitor 10 | 0.1 μF |
| capacitor 16 | 15 μF |
| capacitor 35 | 0.1 μF |
| capacitor 42 | 0.1 μF |
| capacitor 47 | 15 μF |
| capacitor 51 | 0.1 μF |

-continued

| | |
|---|---|
| capacitor 55 | 0.068 μF |
| capacitor 60 | 0.1 μF |
| capacitor 77 | 2.2 nF |
| capacitor 78 | 0.033 μF |
| zenerdiode 17 type BZX 79 B5V6 trademark Philips | |
| zenerdiode 46 type BZX 79 C15 trademark Philips | |
| zenerdiode 48 type BZX 79 C15 trademark Philips | |
| zenerdiode 65 type BZX 79 B6V2 trademark Philips | |
| zenerdiode 66 type BZX 79 B6V2 trademark Philips | |
| zenerdiode 82 type BZX 79 B5V6 trademark Philips | |
| diode 17a type BAV 20 trademark Philips | |
| diode 19 type BAV 20 trademark Philips | |
| diode 21 type BAV 20 trademark Philips | |
| diode 62 type BAV 18 trademark Philips | |
| diode 61 type BAV 18 trademark Philips | |
| diode 75 type BAV 20 trademark Philips | |
| diode 76 type BAV 20 trademark Philips | |
| diode 75a type BAV 20 trademark Philips | |
| diode 57b type BAV 20 trademark Philips | |
| diode 57c type BAV 20 trademark Philips | |
| diode 57d type BAV 20 trademark Philips | |
| stabistor 81 | type BZV 1V5 trademark Philips; |
| light-emitting diode 58 | together opto-coupler |
| photosensitive transistor 50 | CNX 35, trademark Philips; |
| operational amplifier 13 | |
| operational amplifier 23 | together IC LM 224, trademark Signetics; |
| operational amplifier 30 | |
| operational amplifier 37 | |
| transistor 53 | BC 558 |
| transistor 71 | BC 337 |
| coil 2 type HP 80 W/220 V-50 Hz, trademark Philips; | |
| coil 74 1.25 mH-1.6 A, Company Eichoff BV10520 | |
| triac 6 type BT 136-600 E, trademark Philips. | |

A 50 W high-pressure sodium lamp was operated by the circuit arrangement thus proportioned. The lamp had a discharge vessel which had a construction as known from U.S. Pat. No. 4,475,061. The electrode gap was 16.6 mm, which during operation corresponded to a nominal lamp voltage $V_{Ia,n}$ of 90 V and a nominal lamp current $I_{Ia,n}$ of 760 mA.

The filling of the discharge vessel consisted of 10 mg of mercury-sodium amalgam containing 23% by weight of Na and xenon at a pressure of 53.3 kPa at 300° K. The color temperature $T_c$ of the radiation emitted by the lamp was 2500° K.

The luminous efficacy with 100 operating hours is 50 lm/W. The value of $\beta$ is 0.4.

During operation of a 30 W high-pressure sodium discharge lamp, the resistor 5 in the circuit arrangement is increased in value to 1 Q. At a nominal lamp voltage $V_{Ia,n}$ of 90 V and a nominal lamp current $I_{Ia,n}$ of 470 mA, this corresponds to a value of $\beta$ of about 0.3. For this 30 W lamp, have determined what experiments what is the smallest value of $\beta$ is which satisfied the relation $$\frac{\Delta S}{C\Delta I} > 0.$$

This is found to amount to 0.26 in the case where the plateau voltage mainly influences the lamp-voltage-dependent part of the control signal S. When also the re-ignition peak as a whole influences the control signal S, the required $\beta$ is found to amount to about 0.4.

For a comparable lamp having a power of about 30 W, experiments determined the minimum value of $\beta$ with different numbers of operating hours so as to satisfy the relation $$\frac{\Delta S}{C\Delta I} > 0.$$

The values found are as follows:

| | |
|---|---|
| 100 operating hours | $\beta = 0.20$ |
| 1000 operating hours | $\beta = 0.12$ |
| 2000 operating hours | $\beta = 0.17$ |
| 3000 operating hours | $\beta = 0.20.$ |

For the aforementioned 30 W lamp, with $\beta=0.3$ the influence of an abrupt variation of the alternating voltage supply has been determined at the average lamp voltage, the color temperature $T_c$ and the coordinates of the color point. The abrupt variations are 10% with respect to the nominal supply voltage of 220 V. The results are indicated in Table I during operations with the circuit arrangement and in Table II during operation without the circuit arrangement.

TABLE I

| | | | |
|---|---|---|---|
| Supply alternating voltage (V) | 198 | 220 | 242 |
| average lamp voltage (V) | 102.3 | 104.8 | 105.6 |
| color temperature $T_c$(K) | 2470 | 2493 | 2498 |
| coordinates of the color point | x.483 | .481 | .480 |
| | y.419 | .419 | .418. |

TABLE II

| | | | |
|---|---|---|---|
| Supply voltage (V) | 198 | 220 | 242 |
| average lamp voltage (V) | 72.1 | 88.9 | 113.7 |
| lamp power (W) | 24.9 | 31 | 43.9 |
| color temperature $T_c$(K) | 2205 | 2453 | 2980 |
| coordinates of the color point | x.515 | .481 | .436 |
| | y.430 | .419 | .402 |

The values of the average lamp voltage indicated in Table I are comparatively high due to the strongly increased re-ignition peak with the use of the circuit arrangement as compared with the operation of the lamp without the circuit arrangement. The indicated lamp voltage values are measured according to the R.M.S. principle. However, it is remarkable that a variation of 10% in the supply voltage with the use of the circuit arrangement results in a variation of the average lamp voltage of not more than about 2%. Without the use of the circuit arrangement, on the contrary, a variation in the average lamp voltage up to even 28% is obtained.

Two 30 W lamps of the same type as described above are operated in the same manner without the use of the circuit arrangement described. The most important results are:

| | lamp 1 | lamp 2 |
|---|---|---|
| Average lamp voltage (V) | 79.8 | 88.9 |
| Color temperature $T_c$(K) | 2309 | 2453 |
| Coordinate of the color point | x.502 | .485 |
| | y.426 | .420 |

With a corresponding operation with the use of the circuit arrangement described, the results are:

| | lamp 1 | lamp 2 |
|---|---|---|
| Average lamp voltage (V) | 101.3 | 104.8 |
| color temperature $T_c$(K) | 2470 | 2493 |
| coordinates of the color point | x.483 | .481 |

-continued

| | lamp 1 | lamp 2 |
|---|---|---|
| | y.419 | .419. |

What is claimed is:

1. A circuit arrangement for operating a high-pressure discharge lamp comprising:

a pair of input terminals for a source of supply voltage, a controlled current limiter coupled to said input terminals and to a discharge lamp for regulating lamp current in response to a switching signal derived in a control circuit of the circuit arrangement, said control circuit including means for comparing a reference signal with a lamp-dependent control signal S to device an auxiliary signal, said control circuit further comprising means for adding a lamp-voltage-dependent signal and a lamp-current-dependent signal to derive said control signal S from the summation of said lamp voltage and current dependent signals, wherein the summation satisfies the relation $$S = C(\beta I_{Ia}/I_{a,n} + V_{Ia}/V_{Ia,n})$$

where $I_{Ia}$ is the current through the lamp in A, $I_{Ia,n}$ is nominal lamp current in A, $V_{Ia}$ is the voltage across the lamp in V, $V_{Ia,n}$ is nominal lamp voltage in V, $\beta$ is a constant, and C is a proportionality constant expressed in V, and the value of $\beta$ satisfies the relation $0.1 < \beta > 0.5$, and means responsive to the auxiliary signal for deriving said switching signal.

2. A circuit arrangement as claimed in claim 1 wherein said switching signal deriving means includes a comparator having a second input that receives said auxiliary signal and a first input, means for supplying to the first input of the comparator a sawtooth-shaped signal having a direct voltage signal added thereto whereby the switching signal is the result of the comparison of the signals appearing at the first and second inputs of the comparator.

3. A circuit arrangement as claimed in claim 2 wherein said signal supplying means comprises a first series-combination of a first semiconductor element with a diode characteristic, a capacitor shunted by a switch, and a first resistor, and means connecting a junction between said capacitor and the first resistor to the first input of the comparator to supply thereto said sawtooth-shaped signal.

4. A circuit arrangement as claimed in claim 3, characterized in that a second series-combination comprising a first semiconductor element with a Zener characteristic and a second resistor is connected parallel to the first series-combination and in that a junction between the first semiconductor element and the second resistor is connected to the second input of the comparator.

5. A circuit arrangement as claimed in claim 1, characterized in that $\beta$ is chosen so that for the control signal S $$\frac{\Delta S}{C\Delta I} > 0,$$

where $\Delta I$ is an abrupt variation in the lamp current and $\Delta S$ is an abrupt variation in the control signal S due to $\Delta I$.

6. A circuit arrangement as claimed in claim 5 wherein said switching signal deriving means comprises means for deriving a sawtooth signal having a direct voltage signal added thereto, and second means for comparing said sawtooth signal with the auxiliary signal proportional to the control signal S so as to provide a second comparison that produces said switching signal.

7. A circuit arrangement as claimed in claim 1, further comprising a voltage divider circuit which, when the lamp is connected, is connected electrically parallel to the lamp and of which a first part provides the lamp-voltage-dependent signal part of the control voltage S, said first part being shunted by at least a semiconductor element with a diode characteristic.

8. A circuit arrangement as claimed in claim 7, wherein the supply voltages comprises an alternating voltage supply, characterized in that the first part of the voltage divider circuit is shunted by a second and a third semiconductor element with a Zener characteristic connected with opposite polarities.

9. A circuit arrangement as claimed in claim 1, characterized in that the circuit arrangement is joined with the controlled current limiter to form a single device.

10. A device for operating a high-pressure discharge lamp comprising a controlled current limiter in combination with the circuit arrangement claimed in claim 1.

11. A circuit for operating a discharge lamp having a nominal lamp current and a nominal lamp voltage comprising: a pair of input terminals for a source of supply voltage for the circuit, a ballast impedance, a controlled current limiter, means for connecting the ballast impedance, the controlled current limiter and a discharge lamp in series across the input terminals, means for deriving a first signal component dependent on lamp voltage, means for deriving a second signal component dependent on lamp current, means for deriving a reference signal, means for generating a switching signal, said generating means including means for combining said first and second signal components to derive a control signal S, means for comparing said reference signal and said control signal S, and means coupled to an output of the comparing means supplying a switching signal to the controlled current limiter for controlling the supply of electrical energy to a discharge lamp, and wherein the control signal S satisfies the relation:

$$S = C\left(\beta \frac{I_{Ia}}{I_{Ia,n}} + \frac{V_{Ia}}{V_{Ia,n}}\right) \text{with } 0.1 < \beta < 1$$

where:

$I_{Ia}$ is the current through the lamp in A $I_{Ia,n}$ is the nominal lamp current in A, $V_{Ia}$ is the voltage across the lamp in V, $V_{Ia,n}$ is the nominal lamp voltage in V, $\beta$ is a constant, and C is a proportionality constant expressed in V.

12. A circuit as claimed in claim 11 wherein said comparing means comprises a first comparator for comparing the reference signal and the control signal S to derive an auxiliary signal proportional to the control signal S and a second comparator having a first input coupled to receive said auxiliary signal and having a second input, means for deriving a sawtooth signal voltage having a direct voltage signal component, and means for supplying said sawtooth signal to said second input of the second comparator whereby said switching signal is developed at an output of the second comparator.

13. A circuit as claimed in claim 12 wherein said sawtooth signal deriving means comprises a first series combination including a first semiconductor element having a diode characteristic, a capacitor, and a first resistor, and a semiconductor switch connected in shunt with the capacitor.

14. A circuit as claimed in claim 13 further comprising a second series combination including a first semiconductor element having a zener characteristic and a second resistor, the second series combination connected in parallel with the first series combination, and means coupling a junction point in the second series combination to the first input of the second comparator.

15. A circuit as claimed in claim 11 wherein the lamp is a high-pressure discharge lamp and $\beta$ is chosen so that $$\frac{\Delta S}{C\Delta I} > 0,$$

wherein $\Delta I$ is a abrupt variation in lamp current and $\Delta S$ is an abrupt variation in the control signal S due to $\Delta I$.

16. A circuit for operating a high-pressure discharge lamp whose current is limited by a controlled current limiter comprising:

means for deriving first and second signals dependent on lamp voltage and lamp current, respectively, wherein said deriving means comprises a voltage-divider for connection in parallel with a lamp to derive said first signal and a resistor for connection in series with the lamp to derive the second signal, and wherein components of the voltage-divider are chosen relative to said resistor so that the first signal is always larger than the second signal, first and second Zener diodes connected in series opposition and in shunt with at least a part of said voltage-divider, means for summing said first and second signals to derive a control signal S, means for comparing the control signal S with a reference signal to produce an auxiliary signal, and means responsive to said auxiliary signal for developing a switching signal for the controlled current limiter such that the controlled current limiter is switched in a manner to maintain the average lamp operating voltage substantially constant.

17. A circuit as claimed in claim 16 for operating the lamp from a periodic AC supply voltage wherein said comparing means includes an integration circuit with a time constant that is large in relation to the period of the AC supply voltage thereby to provide an averaging of the control signal S and thus an averaging of the lamp current and lamp voltage.

* * * * *

UNITED STATES PATENT AND TRADEMARK OFFICE

CERTIFICATE OF CORRECTION

PATENT NO. : 5,039,916

DATED : August 13, 1991

INVENTOR(S) : LODEWIJK H.M. MEESSEN ET AL

It is certified that error appears in the above-identified patent and that said Letters Patent is hereby corrected as shown below:

IN THE ABSTRACT line 1, delete "suitable";
line 6, delete "invention, the";
line 10, delete the comma.

IN THE SPECIFICATION

Column 2, line 63, delete "of";

Column 6, line 40, change "constituted" to -- constitutes--;
line 50, change "$CI_i$" to --$\frac{C}{I_{Ia,n}}$--;
line 51, delete "Ia,n"; change "$CV_{iIa,n}$" to --$\frac{C}{V_{Ia,n}}$--;

Column 7, line 41, after "operational" insert --amplifier 37. When a high voltage is present at the output 38, the transistor--;

Column 9, line 52, after "lamp," insert --experiments--; delete "what experiments";
line 53, delete "is" (first occurrence).

UNITED STATES PATENT AND TRADEMARK OFFICE

CERTIFICATE OF CORRECTION

PATENT NO. : 5,039,916

DATED : August 13, 1991

INVENTOR(S) : LODEWIJK H.M, MEESSEN ET AL

It is certified that error appears in the above-identified patent and that said Letters Patent is hereby corrected as shown below:

IN THE CLAIMS

Claim 1; column 11, line 34, change ">" to --<--.
Claim 6, line 6, after "signal" (second occurrence) insert --, said auxiliary signal being--;
line 9, after "S" insert --,-- (comma); delete "provide a";
line 10, delete "second comparison that"; change "produces" to --produce--.
Claim 10, cancel.
Claim 11, line 16, after "means" insert --for--;
line 21, change "<1" to --<0.5--;
Claim 15; column 13, line 30 , change "a" to --an--.

Signed and Sealed this

Twelfth Day of January, 1993

*Attest:*

DOUGLAS B. COMER

*Attesting Officer*

*Acting Commissioner of Patents and Trademarks*